US008540036B2

(12) United States Patent
Overstreet

(10) Patent No.: US 8,540,036 B2
(45) Date of Patent: Sep. 24, 2013

(54) ULTRAHARD SINTERED CARBIDE PARTICLES IN HARDFACING FOR EARTH-BORING BIT

(75) Inventor: James L. Overstreet, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 336 days.

(21) Appl. No.: 12/893,953

(22) Filed: Sep. 29, 2010

(65) Prior Publication Data

US 2011/0073378 A1 Mar. 31, 2011

Related U.S. Application Data

(60) Provisional application No. 61/246,711, filed on Sep. 29, 2009.

(51) Int. Cl.
*E21B 10/36* (2006.01)
*E21B 10/46* (2006.01)

(52) U.S. Cl.
CPC ..... *E21B 10/46* (2013.01)
USPC ..... 175/425; 175/428; 175/433; 75/240

(58) Field of Classification Search
USPC ..... 175/425, 428, 433; 75/240
See application file for complete search history.

(56) References Cited

U.S. PATENT DOCUMENTS

| | | | | |
|---|---|---|---|---|
| 4,196,233 | A * | 4/1980 | Bitzer et al. | 427/249.1 |
| 7,666,244 | B2 | 2/2010 | Lockwood | |
| 2003/0079565 | A1 * | 5/2003 | Liang et al. | 75/240 |
| 2006/0005662 | A1 | 1/2006 | Lockwood | |

* cited by examiner

*Primary Examiner* — Cathleen Hutchins
(74) *Attorney, Agent, or Firm* — TraskBritt

(57) ABSTRACT

A hardfacing composition for downhole well tools, such as earth-boring bits, contains sintered ultrahard particles. The ultrahard particles consist of tungsten carbide grains, cobalt and vanadium. The ultrahard particles are dispersed within a matrix metal of iron, nickel or alloys thereof. The composition may also have sintered tungsten carbide particles of a larger size than the ultrahard particles. The ultrahard particles have a greater hardness than the sintered tungsten carbide particles. The ultrahard particles and the sintered tungsten carbide particles may be in a spherical pellet form. Other hard metal particles may be in the composition.

21 Claims, 5 Drawing Sheets

ULTRAHARD SINTERED CARBIDE PARTICLES IN HARDFACING FOR EARTH-BORING BIT

CROSS-REFERENCE TO RELATED APPLICATION

This application claims priority to U.S. Provisional Patent Application Ser. No. 61/246,711 filed Sep. 29, 2009.

FIELD OF THE INVENTION

This invention relates in general to hardfacing on earth-boring bits and, in particular, to a hardfacing containing a mixture of ultrahard sintered tungsten carbide pellets with other types of tungsten carbide pellets.

BACKGROUND

Hardfacing has been used for many years on earth-boring bits to reduce the abrasive and/or erosive wear. The hardfacing typically comprises hard metal particles dispersed within a metal matrix. The hard metal particles are often formed of tungsten carbide. Sintered tungsten carbide, also called cemented carbide, comprises tungsten carbide grains within a binder powder, such as cobalt. The tungsten carbide grains utilized in sintered tungsten carbide pellets are generally less than ten microns in diameter. During this sintering process, which employs heat and pressure, the cobalt will enter a liquid stage while the tungsten carbide grains remain in the solid stage. As a result of this process, the cobalt cements the tungsten carbide grains to create sintered tungsten carbide. The ductile cobalt metal offsets the characteristic brittleness of the tungsten carbide particles, resulting in a pellet that has enhanced toughness and durability. Sintered tungsten carbide pellets can be formed into generally spherical shapes or irregular shapes. Also, sintered tungsten carbide in a crushed form is available.

Cast tungsten carbide particles are formed in a casting process, and, thus, are harder than sintered tungsten carbide and do not have a binder of a soft metal such as cobalt. Cast tungsten carbide particles may be spherical, irregular or crushed. Spherical cast carbide pellets are typically smaller in diameter than standard spherical sintered tungsten carbide pellets. Cast tungsten carbide particles are thus harder than sintered tungsten carbide particles but more brittle.

Prior art hardfacing for earth-boring bits contains a variety of sizes and volume fractions of standard spherical sintered tungsten carbide pellets, crushed sintered tungsten carbide particles, spherical cast tungsten carbide pellets, crushed cast tungsten carbide particles, as well as other types of cast tungsten carbide, such as monocrystalline or macrocrystalline particles. The matrix that contains and binds the hardfacing pellets and particles is often iron, but it also may contain nickel and/or other alloys.

SUMMARY

The hardfacing composition described herein includes particles referred to herein for convenience as "ultrahard" particles. The ultrahard particles are sintered and consist of tungsten carbide grains, cobalt and vanadium. The ultrahard particles are dispersed within a matrix metal of iron, nickel or alloys thereof. In one embodiment, the ultrahard particles comprise 4 to 8% cobalt, 0.25% to 2% vanadium, with the remainder being tungsten carbide.

The composition may also contain conventional sintered tungsten carbide particles, typically of a larger size than the ultrahard particles. The ultrahard particles have a greater hardness than the sintered tungsten carbide particles. The composition may also include cast tungsten carbide particles. The ultrahard particles have a lesser hardness than cast tungsten carbide particles but greater toughness. The ultrahard particles may be in a spherical form or a crushed form.

BRIEF DISCUSSION OF THE DRAWINGS

DETAILED DESCRIPTION OF THE INVENTION

Figure 1:
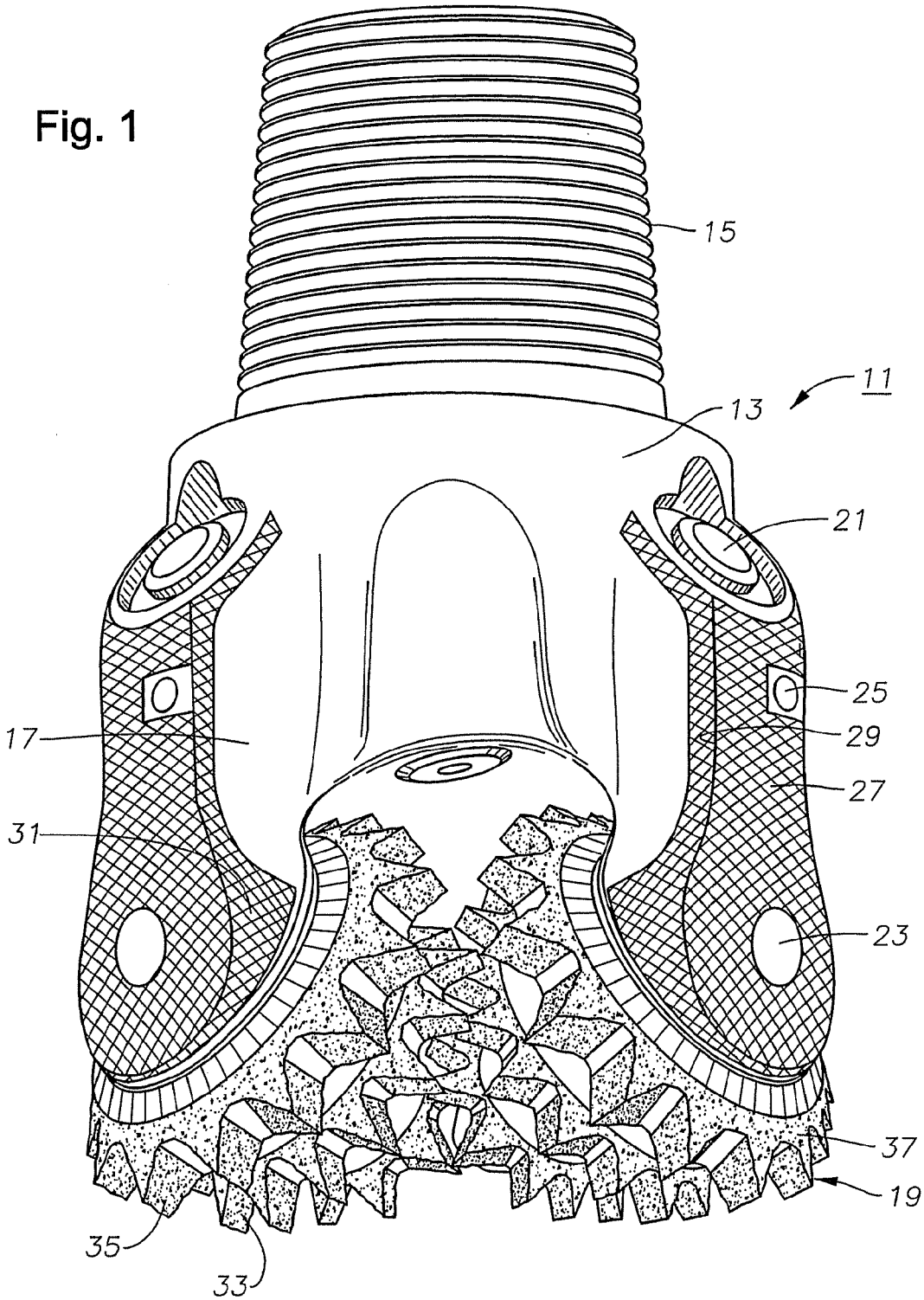
FIG. 1 is a side elevational view of an earth-boring bit having hardfacing in accordance with this invention.

FIG. 1 illustrates an earth-boring bit 11 having a body 13. A threaded stem 15 extends upward from body 13 for connection to a string of drill pipe. Body 13 has at least one bit leg 17, typically three. A cone 19 is rotatably mounted to each bit leg 17. A lubricant reservoir supplies grease to the bearing spaces between each cone 19 and bit leg 17. A pressure compensator cap 21 encloses the upper end of each reservoir. Typically, each cone 19 is secured by retaining balls (not shown). The retaining balls are fed through a hole in each bit leg 17, then the hole is plugged by a ball plug 23, which is welded to bit leg 17. After assembling a cone 19 on each bit leg 17, the three separate portions of body 13 are welded together. The fixture for holding the three portions in place during welding may engage a dimple 25 on the outside surface of each bit leg 17.

Bit 11 contains hardfacing in various places to prevent wear on the steel components. In this embodiment, bit leg outer surface hardfacing 27 covers the entire outer surface of each bit leg 17 except for ball plug 23 and fixture dimple 25. Hardfacing 27 extends from the lower end, or shirttail, of each bit leg 17 to the recess containing pressure compensator cap 21. A leading edge hardfacing 29 extends over the leading edge of each bit leg 17. A trailing edge hardfacing 31 extends over the trailing edge of each bit leg 17. Leading edge hardfacing 29 and trailing edge hardfacing 31 join outer surface hardfacing 27.

A robotic process may serve as the method of applying hardfacing layers 27, 29 and 31. In a plasma transferred arc (PTA) process, hardfacing powder flows down a nozzle to an arc. The arc moves relative to the bit leg 17 during the application. Other methods are available, such as using an oxyacetylene torch and a rod. Some earth-boring bits 11 may have outer surface hardfacing 27 applied only on the lower edge or shirttail. Some bits may have only leading edge hardfacing 29 and not trailing edge hardfacing 31. The compositions of outer surface hardfacing 27, leading edge hardfacing 29 and trailing edge hardfacing 31 may be the same or may differ.

Cones 19 also contain layers of hardfacing, particularly if it is a milled tooth type. In a milled tooth bit, cones 19 have rows of machined or milled teeth 33 that are formed integrally with the body of each cone 19. Teeth 33 contain layers of teeth hardfacing 35. Teeth hardfacing 35 covers the leading and trailing flanks and the inner and outer sides of each tooth 33. Each cone 19 has a gage surface that may contain a layer of gage hardfacing 37 for engaging the side wall of the bore hole. Teeth hardfacing 35 and gage surface hardfacing 37 are typically applied by heating with an oxyacetylene torch a metal tube filled with hard metal particles. The hardfacing layers 35, 37 on cones 19 often have different compositions than hardfacing layers 27, 29 and 31 on bit leg 17.

Figure 2:
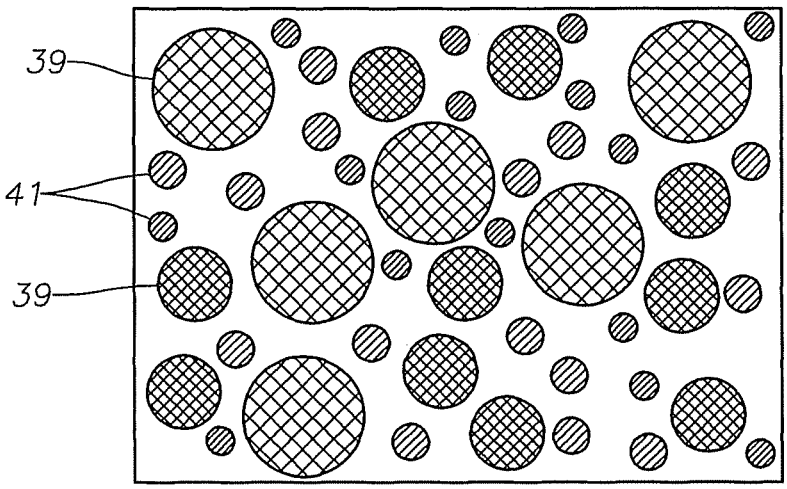
Fig. 2 (Prior Art)
FIG. 2 is a schematic photomicrograph illustrating a prior art hardfacing having sintered tungsten carbide pellets and spherical cast tungsten carbide pellets.

FIG. 2 illustrates a prior art example of the composition of hardfacing applied as one or all of the layers 27, 29, 31, 35 and 37. FIG. 2 illustrates standard spherical sintered tungsten carbide pellets 39 and spherical cast tungsten carbide pellets 41. Standard spherical sintered tungsten carbide pellets 39 are normally larger in diameter than spherical cast tungsten carbide pellets 41. Standard spherical sintered tungsten carbide pellets 39 have a binder, normally cobalt, that binds the carbide powder. Standard spherical sintered tungsten carbide pellets 39 are available in a variety of sizes from about 16 mesh on the larger size to about 325 mesh on the smaller size. Stated in another manner, the size range could be from about 45 micrometers ("microns") to about 1190 microns.

Sintered tungsten carbide, also called cemented carbide, comprises tungsten carbide grains within a binder powder, such as cobalt. The tungsten carbide grains utilized in standard spherical sintered tungsten carbide pellets 39 are generally less than ten microns in diameter. During this sintering process, which employs heat and pressure, the cobalt will enter a liquid stage while the tungsten carbide grains remain in the solid stage. As a result of this process, the cobalt cements the tungsten carbide grains to create sintered tungsten carbide. The ductile cobalt metal offsets the characteristic brittleness of the tungsten carbide particles, resulting in a pellet that has enhanced toughness and durability. Sintered tungsten carbide pellets can be formed into generally spherical shapes or irregular shapes. Also, sintered tungsten carbide in a crushed form is available. The hardness of standard spherical sintered tungsten carbide pellets 39 ranges from about 1368 KHN (Knoop hardness), which is approximately 89.5 HRA (hardness Rockwell A), to about 1587 KHN (approximately 91.7 HRA).

Spherical cast tungsten carbide pellets 41 are formed in a casting process, and thus, are harder than sintered tungsten carbide and do not have a binder of a soft metal such as cobalt. Cast tungsten carbide particles may be spherical, irregular or crushed. Spherical cast tungsten carbide pellets 41 are typically smaller in diameter than standard spherical sintered tungsten carbide pellets 39. Hardness levels for spherical cast tungsten carbide pellets 41 range from about 1992 KHN (approximately 95.7 HRA) to about 2223 KHN (approximately 97.9 HRA). Typical sizes for spherical cast tungsten carbide pellets 41 in bit hardfacing are in the range from 44-250 microns. Spherical cast tungsten carbide pellets 41 are thus harder than standard spherical sintered tungsten carbide pellets 39 but more brittle. Standard spherical sintered tungsten carbide pellets 39 are tougher than spherical cast tungsten carbide pellets 41. Prior art hardfacing for earth-boring bits contains a variety of sizes and volume fractions of standard spherical sintered tungsten carbide pellets, crushed sintered tungsten carbide particles, spherical cast tungsten carbide pellets, crushed cast tungsten carbide particles, as well as other types of cast tungsten carbide, such as monocrystalline or macrocrystalline particles. The matrix that contains and binds the hardfacing pellets and particles is often iron, but it also may contain nickel or other alloys.

Figure 3:
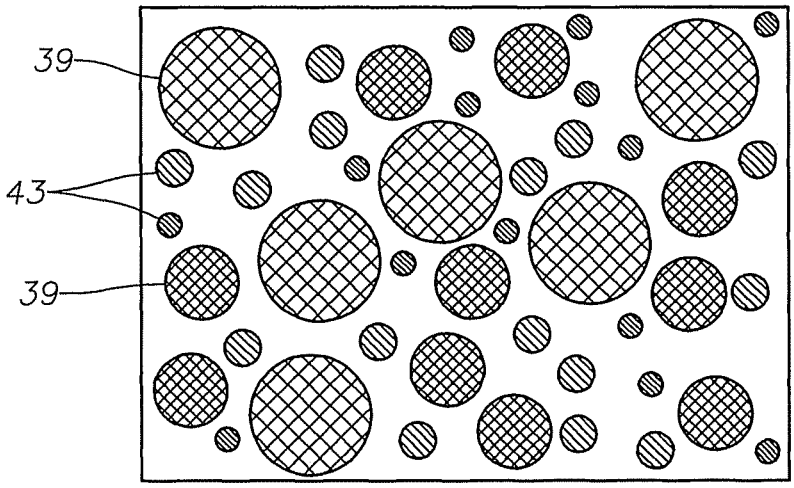
FIG. 3 is a schematic photomicrograph illustrating a hardfacing having ultrahard spherical sintered tungsten carbide pellets mixed with standard spherical sintered tungsten carbide pellets.

Referring to FIG. 3, in this embodiment, harder spherical sintered tungsten carbide pellets 43, referred to herein as "ultrahard pellets," are substituted for the spherical cast tungsten carbide pellets 41. Ultrahard pellets 43 differ in composition from standard spherical sintered tungsten carbide pellets 39 used in bit hardfacing. During the manufacturing of the powder used for ultrahard particles, submicron size tungsten carbide grains are blended with a binder of cobalt along with vanadium powder. During the sintering process, the vanadium inhibits the tungsten carbide grains from growing larger. Since the tungsten carbide grains remain small, the resulting sintered composition is very hard compared to standard sintered tungsten carbide. Iron and nickel might also be used as a binder either as a whole or in some combination with the cobalt binder. The vanadium thus serves as a tungsten carbide grain growth inhibitor. The quantity of vanadium may be as little as 0.25 percent and as much as 2 percent by weight of the total weight of the ultrahard pellet 43. A typical composition may be 4 to 8 percent cobalt, preferably 6 percent, 0.25 percent to 2 percent vanadium, and with the remainder being tungsten carbide. Ultrahard pellets 43 range in hardness from about 95 to 96 HRA. The sizes of ultrahard pellets 43 may be the same as standard spherical sintered tungsten carbide pellets 39, such as from 16 mesh to 325 mesh. For torch applications, such as on cones 19 (FIG. 1), the size range may be from about 177 to 250 microns, which is a typical prior art size range for spherical cast tungsten carbide pellets for torch applications. For pulse transferred arc (PTA) applications, such as on bit legs 17 (FIG. 1), the size range may about 44 to 250 microns, which is approximately the size range used in the prior art for spherical cast tungsten carbide pellets with PTA applications. The sizes can be larger if ultrahard pellets are to be used to replace conventional spherical sintered tungsten carbide pellets used in torch applications, for example, up to about 1190 microns. Ultrahard pellets 43 may be, spherical or irregular in shape, or sintered tungsten carbide having the same composition as ultrahard pellets 43 may be crushed.

In the example of FIG. 3, ultrahard pellets 43 are substituted for spherical cast tungsten carbide pellets 41. In this composition, ultrahard pellets 43 are mixed with standard spherical sintered tungsten carbide pellets 39 in the same percentage and roughly the same size ranges as the spherical cast tungsten carbide pellets 41 in FIG. 2.

Figure 4:
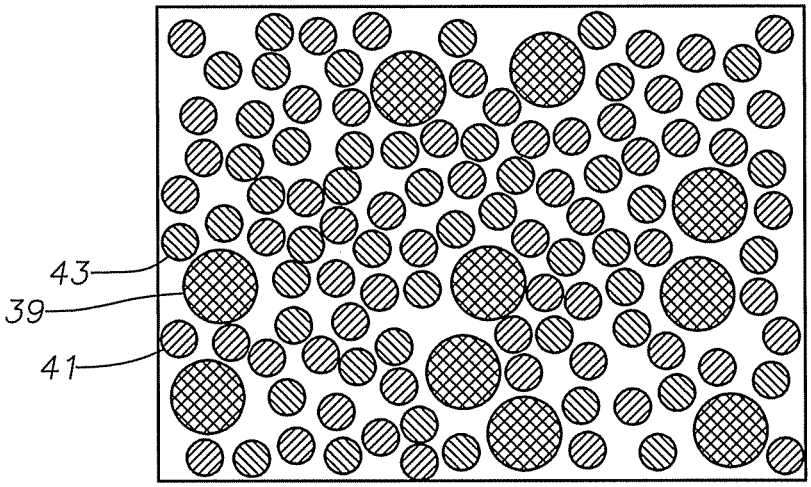
FIG. 4 is a schematic photomicrograph illustrating a hardfacing having ultrahard spherical sintered tungsten carbide pellets mixed with standard spherical sintered and cast tungsten carbide pellets.

In FIG. 4, ultrahard pellets 43 are mixed with spherical cast tungsten carbide pellets 41 and standard spherical sintered tungsten carbide pellets 39. The percentages may vary. The sizes of spherical cast tungsten carbide pellets 41 and ultrahard pellets 43 are relatively the same in this example, but they could vary also.

Figure 5:
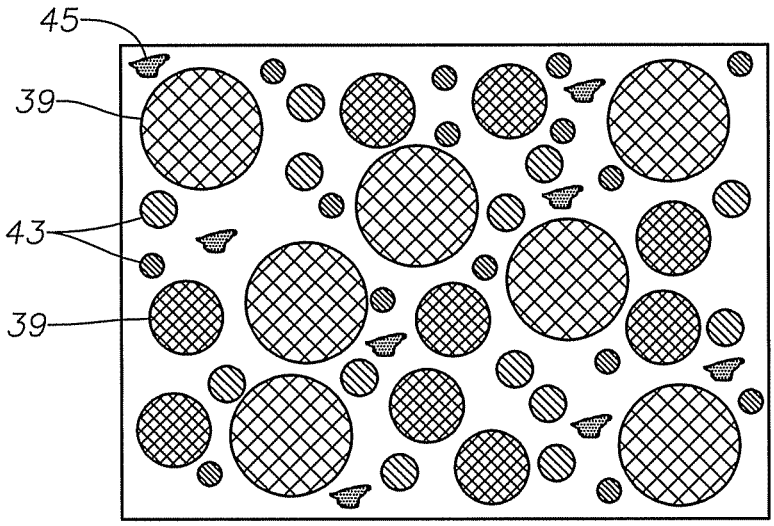
FIG. 5 is a schematic photomicrograph illustrating a hardfacing having ultrahard and standard spherical sintered pellets mixed with ultrahard crushed sintered tungsten carbide particles.

In FIG. 5, a crushed form of spherical ultrahard pellets 43 is used and referred to herein as "crushed ultrahard particles 45." Being crushed, ultrahard particles 45 are irregular in shape rather than spherical. Crushed ultrahard particles 45 may be roughly the same size range as spherical ultrahard pellets 43 or the sizes may differ. In the example of FIG. 5, crushed ultrahard particles 45 are mixed with spherical ultrahard pellets 43 and standard spherical sintered tungsten carbide pellets 39.

Figure 6:
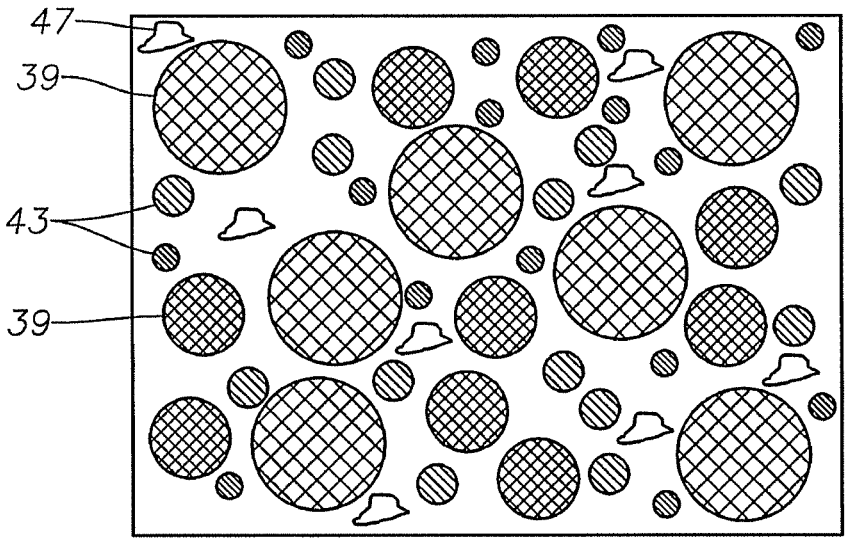
FIG. 6 is a schematic photograph illustrating a hardfacing having ultrahard and standard spherical sintered tungsten carbide pellets mixed with crushed cast tungsten particles.

In FIG. 6, standard spherical sintered tungsten carbide pellets 39 and ultrahard pellets 43 are mixed with crushed cast tungsten carbide particles 47. Crushed cast particles 47 are irregular in shape and may be a variety of sizes. In the example shown, the sizes of crushed cast particles 47 are approximately the same as the sizes of ultrahard pellets 43.

Figure 7:
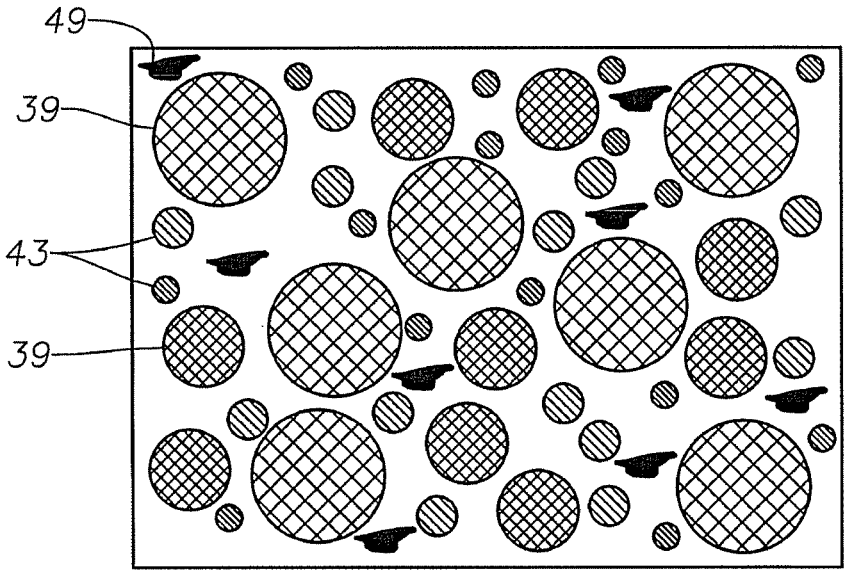
FIG. 7 is a schematic photomicrograph illustrating a hardfacing having ultrahard and standard spherical sintered tungsten carbide pellets in combination with monocrystalline carbide particles.

In FIG. 7, standard spherical sintered tungsten carbide pellets 39 and spherical ultrahard pellets 43 are mixed with monocrystalline particles 49. Monocrystalline particles 49 comprise a single crystal of tungsten carbide and have an irregular shape. If larger than about 20 microns, they may be called macrocrystalline particles. During application, the sharp corners of the monocrystalline particles tend to melt, causing some of the tungsten carbide within to precipitate into the metal matrix. Monocrystalline particles 49 are conventional and available in a variety of sizes. In this example, they are approximately the same size as crushed ultrahard particles 43.

Figure 8:
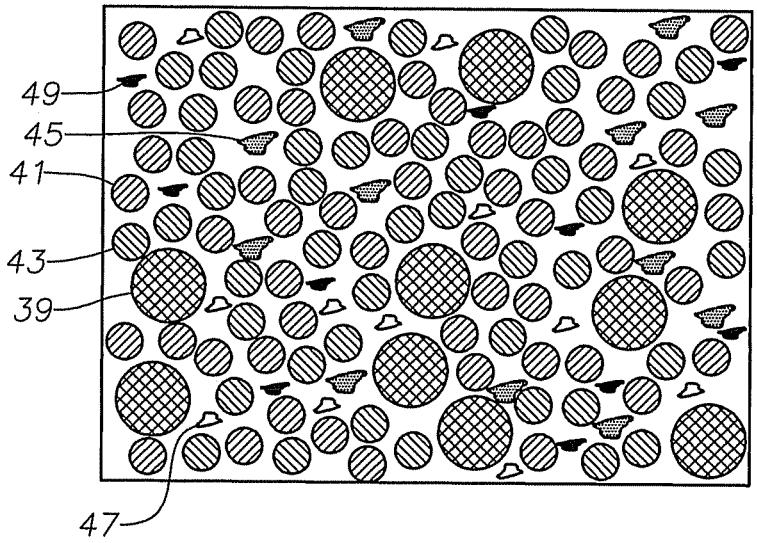
FIG. 8 is a schematic photograph illustrating a hardfacing having ultrahard and standard spherical sintered tungsten carbide pellets with ultrahard crushed sintered tungsten carbide pellets, crushed cast tungsten carbide particles, and monocrystalline tungsten carbide particles.

FIG. 8 discloses a combination of standard spherical sintered tungsten carbide pellets 39, spherical cast tungsten carbide pellets 41, spherical ultrahard pellets 43, crushed ultrahard particles 45 and monocyrstalline particles 49. The percentages and sizes of each may be varied.

The examples of FIGS. 3-8 may be employed with any or all of the hardfacing layers 27, 29, 31 or 35 shown in FIG. 1. Further, the examples of FIGS. 3-8 may be used for hardfacing other downhole tools.

The various compositions described result in an extremely wear and/or erosion resistant material. The ultrahard particles provide more hardness than conventional sintered tungsten carbide particles. Although not as hard as cast tungsten carbide particles, ultrahard particles provide more toughness. Ultrahard particles may be used as a replacement for or in addition to cast tungsten carbide particles.

While several examples have been shown, it should be apparent to those skilled in the art that various changes may be made to these compositions.

The invention claimed is:

1. A hardfacing composition, comprising:

sintered ultrahard pellets, each consisting of tungsten carbide grains, cobalt, and vanadium; and a matrix metal comprising iron, nickel, or alloys thereof, the sintered ultrahard pellets dispersed in the matrix metal.

2. The hardfacing composition of claim 1, further comprising sintered tungsten carbide pellets of a larger size than the sintered ultrahard pellets.

3. The hardfacing composition of claim 2, wherein the sintered ultrahard pellets have a greater hardness than the sintered tungsten carbide pellets.

4. The hardfacing composition of claim 1, further comprising:

cast tungsten carbide pellets exhibiting greater hardness than the sintered ultrahard pellets; and sintered tungsten carbide pellets exhibiting less hardness than the sintered ultrahard pellets, and having a larger size than the sintered ultrahard pellets and the cast tungsten carbide pellets.

5. The hardfacing composition of claim 1, further comprising sintered tungsten carbide pellets, a portion of the sintered ultrahard pellets in a spherical form and another portion of the sintered ultrahard pellets in a crushed form.

6. The hardfacing composition of claim 5, further comprising:

spherical cast carbide pellets;

crushed cast tungsten carbide pellets; and monocrystalline tungsten carbide particles.

7. The hardfacing composition of claim 1, wherein the sintered ultrahard pellets are in a spherical form, and further comprising:

spherical sintered tungsten carbide pellets having larger diameters than the sintered ultrahard pellets; and crushed cast tungsten carbide pellets.

8. The hardfacing composition of claim 1, wherein the sintered ultrahard pellets comprise spherical pellets, and further comprising:

spherical sintered tungsten carbide pellets having larger diameters than the sintered ultrahard pellets; and monocrystalline tungsten carbide particles.

9. The hardfacing composition of claim 1, wherein the sintered ultrahard pellets comprise 4 to 8 percent cobalt, 0.25 to 2 percent vanadium, and a remainder of tungsten carbide.

10. A hardfacing composition, comprising:

spherical sintered ultrahard pellets comprising tungsten carbide grains, elemental cobalt, and elemental vanadium; and a matrix metal comprising iron, nickel, or alloys thereof, the spherical sintered ultrahard pellets dispersed in the matrix metal.

11. The composition of claim 10, further comprising spherical sintered tungsten carbide pellets of a larger diameter than the spherical sintered ultrahard pellets.

12. The composition of claim 11, wherein the spherical sintered ultrahard pellets have a greater hardness than the sintered tungsten carbide pellets.

13. The composition of claim 10, wherein diameters of the ultrahard pellets are within a range of from about 177 to 250 microns.

14. The composition of claim 10, further comprising crushed sintered ultrahard pellets comprising tungsten carbide grains, elemental cobalt, and elemental vanadium.

15. The composition of claim 10, wherein the spherical sintered ultrahard pellets comprise 4 to 8 percent cobalt, 0.25 to 2 percent vanadium, and a remainder of tungsten carbide.

16. An earth-boring bit comprising:

a body;

a plurality of bit legs;

a plurality of cones rotatably mounted to the plurality of bit legs;

hardfacing on at least one of the plurality of bit legs and the plurality of cones, and comprising:

spherical sintered ultrahard pellets comprising tungsten carbide grains, elemental vanadium, and at least one of cobalt, iron, and nickel;

spherical sintered tungsten carbide pellets of a larger diametrical size than the spherical sintered ultrahard pellets; and a matrix metal comprising iron, nickel, or alloys thereof, the spherical sintered ultrahard pellets and the sintered tungsten carbide pellets dispersed in the matrix metal.

17. The earth-boring bit of claim 16, wherein the hardfacing is located on outer sides of the plurality of bit legs, and wherein the diametrical sizes of the spherical sintered ultrahard pellets are within a range from about 45 to 250 microns.

18. The earth-boring bit of claim 16, wherein the hardfacing is located on the plurality of cones, and wherein a diametrical size of the spherical sintered ultrahard pellets is within a range from about 177 to 250 microns.

19. The earth-boring bit of claim 16, wherein a hardness of the spherical sintered ultrahard pellets is greater than that of the sintered tungsten carbide pellets.

20. The earth-boring bit of claim 16 wherein the hardfacing further comprises spherical cast carbide pellets having a diametrical size within a range of from about 177 to 250 microns, the spherical cast carbide pellets having a greater hardness than that of the spherical sintered ultrahard pellets.

21. The earth-boring bit of claim 16, wherein the hardfacing is substantially free of cast tungsten carbide pellets.

* * * * *